US006887073B1

(12) United States Patent
Ruffolo

(10) Patent No.: US 6,887,073 B1
(45) Date of Patent: May 3, 2005

(54) BURNER ASSEMBLY WITH GATE VALVE DAMPER

(75) Inventor: Michael Ruffolo, Elmwood Park, IL (US)

(73) Assignee: Midco International, Inc., Chicago, IL (US)

( * ) Notice: Subject to any disclaimer, the term of this patent is extended or adjusted under 35 U.S.C. 154(b) by 0 days.

(21) Appl. No.: 10/813,949

(22) Filed: Mar. 31, 2004

(51) Int. Cl.[7] ..... F23Q 14/26
(52) U.S. Cl. ..... 431/159; 431/266; 431/353
(58) Field of Search ..... 431/159, 266, 431/353; 239/429, 434

(56) References Cited

U.S. PATENT DOCUMENTS

| | | | | |
|---|---|---|---|---|
| 3,144,244 A | * | 8/1964 | Hunter | 432/56 |
| 4,225,392 A | * | 9/1980 | Taylor | 202/93 |
| 5,494,437 A | | 2/1996 | Kubota | 431/181 |
| 5,863,192 A | | 1/1999 | Motegi | 431/8 |
| 5,873,919 A | * | 2/1999 | Vross et al. | 55/315.1 |
| 5,899,680 A | | 5/1999 | Motegi | 431/8 |
| 5,934,898 A | | 8/1999 | Fayerman | 431/353 |
| 5,975,887 A | | 11/1999 | Kamal | 431/181 |
| 6,050,809 A | | 4/2000 | Fayerman | 431/114 |
| 6,267,586 B1 | | 7/2001 | Maricic | 431/354 |
| 6,485,293 B1 | | 11/2002 | Li | 431/266 |
| 6,544,031 B2 | | 4/2003 | Li | 431/266 |

* cited by examiner

*Primary Examiner*—Stephen Gravini
(74) *Attorney, Agent, or Firm*—Marshall, Gerstein & Borun LLP

(57) ABSTRACT

A damper for a burner includes a gate plate that moves generally parallel to the inlet of a blower housing of the burner. The gate plate rotates parallel to the inlet and is sized and positioned so that it can rotate between a position completely covering the inlet and a position leaving the inlet completely uncovered. A seal assembly between the gate plate and the inlet substantially seals a gap between the gate plate and the inlet. An actuator moves the gate plate automatically to close the damper or open the damper to any of a plurality of open damper positions.

24 Claims, 10 Drawing Sheets

BURNER ASSEMBLY WITH GATE VALVE DAMPER

FIELD OF THE DISCLOSURE

The present disclosure generally relates to burner assemblies, and more particularly, to burner assemblies with gate valve dampers.

BACKGROUND

Burner assemblies which combust gas, such as propane and natural gas, are well known and widely applied. For example, boilers, furnaces, kilns, incinerators, dryers, and food processing equipment all commonly rely upon the heat generated by such combustion for proper operation.

Prior art burner assembly designs have been created to mix a combustible gas with air and provide a spark for the purpose of starting. Extensive attention has been directed to finding proper mixing ratios and to creating apparatus for obtaining such ratios to most efficiently burn the gas while maximizing BTU output.

The airflow characteristics influence BTU output, flame stability, CO and $NO_x$ emissions. BTU output is a measure of the strength of the flame and its resulting heat output, and is a function of, among other things, the amounts of air and gas combined and the ratio at which they are combined. Flame stability relates to the maintainability and controllability of the flame. If the gas/air ratio becomes too rich or too lean, the flame can be lost or can burn inefficiently. CO and $NO_x$ emission control is critical in complying with various environmental regulations. If the flame is not suitably confined, shaped, and directed, all three of the foregoing characteristics will be adversely affected.

Prior art burner assembly designs use a damper for controlling the amount of combustion air entering the burner. Such dampers are typically of the louver type or butterfly valve type and can be opened and closed in various degrees to control the amount of air entering the burner. Because the ratio of combustion gas to combustion air highly influences burner efficiency and burner emissions, precise control of the amount of air entering the burner is critical.

However, both the louver type and the butterfly valve dampers cannot precisely control the amount of air entering the burner. When one or more louvers of a louver type damper are closed, air can seep into the burner from small gaps between each pair of louvers and from the sides of each louver. Even when the louvers are closed, air can seep into the burner from the sides of each louver. Accordingly, precise control of air entering the burner cannot be achieved with louver type dampers. Similarly, a rotating gate of the butterfly valve cannot precisely control the amount of air entering the burner because of air leaks between the rotating gate and air ports, which the gate opens and closes.

SUMMARY

A burner assembly includes a blower having an inlet, and a gate plate moveable relative to the inlet and adapted to control combustion air entering the blower from the inlet. The burner assembly further includes a seal assembly disposed between the gate plate and the inlet.

A damper for a burner assembly includes a base plate mounted on the burner assembly and having an aperture sized to communicate with an air inlet of the burner assembly, and a gate plate moveable relative to the inlet and adapted to control the supply of combustion air entering the inlet from the aperture. The burner further includes a seal assembly disposed between the base plate and the gate plate.

A burner assembly includes a blower having an air inlet, and a base plate mounted on the inlet and having an aperture sized to communicate with the inlet, and a gate plate moveable generally parallel to the inlet and adapted to control combustion air entering the inlet from the aperture. The burner assembly further includes a seal assembly disposed between the base plate and the gate plate.

DETAILED DESCRIPTION

Figure 1:
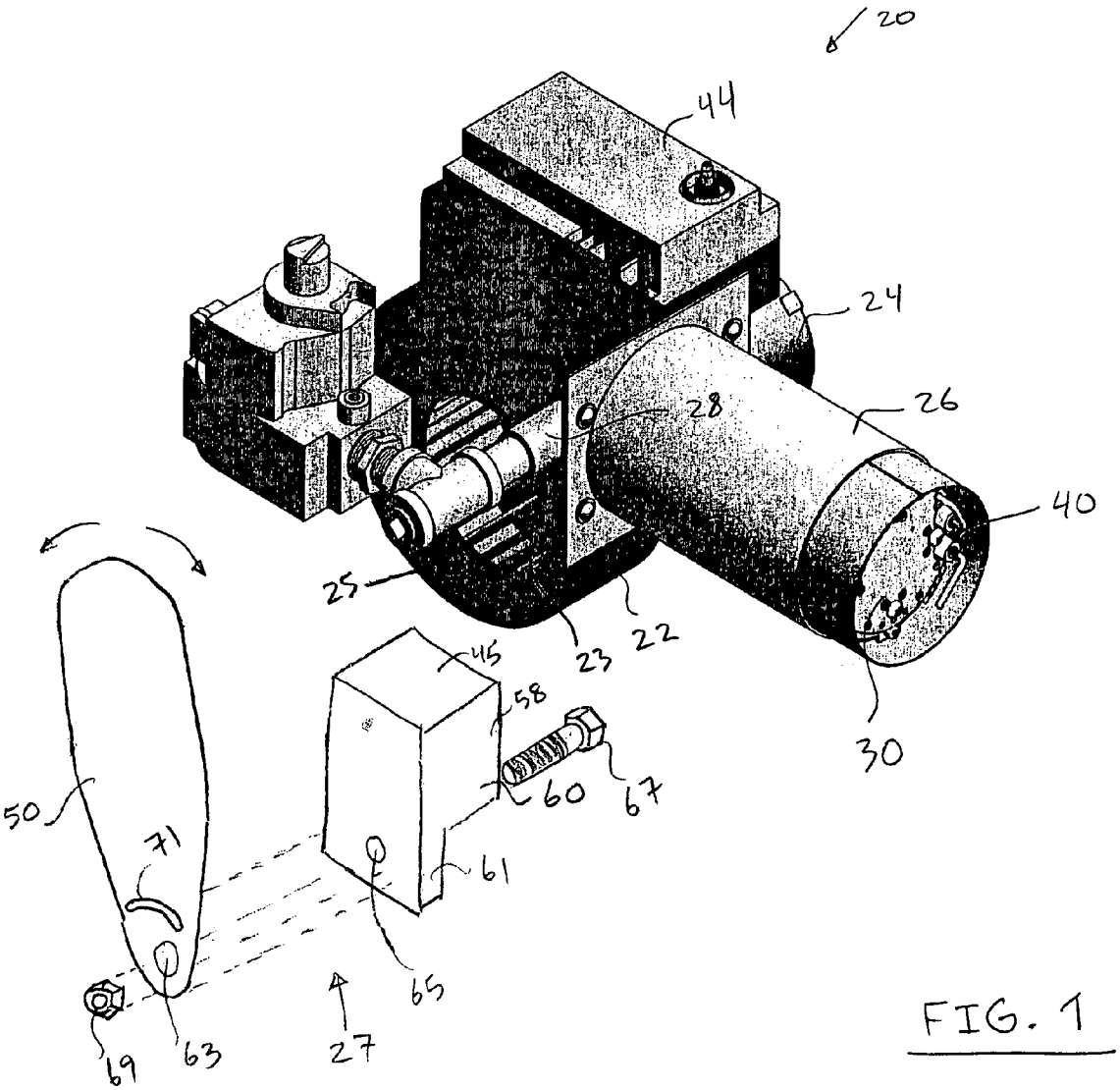
FIG. 1 is a perspective partially exploded view of a burner assembly having a gate valve damper with a seal assembly constructed in accordance with the teachings of the first example of the present disclosure.

Referring now to the drawings and with specific reference to FIGS. 1, 4, 6 and 9, a burner assembly having a gate valve damper constructed in accordance with the teachings of the present disclosure is generally depicted by reference numeral 20. The burner 20 includes a blower housing 22 in which a blower fan 23 is adapted to rotate. The fan is powered by a motor 24. The blower housing 22 includes an inlet 25 for receiving combustion air. A damper 27 mounted on the blower housing 22 controls the supply of air entering the blower housing 22 from the inlet 25. An air flow created by the blower fan is directed through a burner tube 26, which is shown to be substantially cylindrical in shape. A gas supply conduit 28 that is concentrically housed in the burner tube 26 supplies combustible gas to a burner head assembly 30, which is also disposed in the burner tube 26. The burner head assembly 30 is attached to the gas supply conduit 28 and is disposed near an outlet 32 of the burner tube 26. Accordingly, combustion gases are delivered to the burner head assembly 30 by the gas supply conduit 28, while combustion air is delivered to the burner head assembly 30 by burner tube 26. The burner 20 is primarily directed to combustion of propane, but is to be understood that other gases, including but not limited to natural gas, can be employed.

A flame rod assembly 40 is positioned near the burner head assembly 30 to detect and ensure the presence of a flame. Such flame rod assemblies 40 are conventional and may operate by communicating with a controller 44 of the burner 20. The controller 44 may be in communication with a higher level integrated control system (not shown), which may take advantage of the signal to provide an indication to an operator as to whether a flame is present.

The burner head assembly 30 provides initial ignition such that upon actuation of the motor 24, and flow of gas through the gas supply conduit 28 and the burner head assembly 30, overall ignition of the burner 20 is insured. Ignition and continuous operation of the burner 20 are verified by the flame rod assembly 40 and the controller 44.

Referring to FIGS. 1–10, a gate valve damper 27 ("damper 27") constructed in accordance with the teachings of the present disclosure includes a gate plate 50 that can rotate generally parallel to the plane of the inlet 25. The gate plate 50 is sized and positioned so that it can rotate between a position completely covering the inlet 25 and a position leaving the inlet 25 completely uncovered. Accordingly, rotation of the gate plate 50 relative to the inlet 25 can provide a plurality of damper positions including: a fully closed position, where combustion air substantially cannot enter the blower housing 22 from the inlet 25; a plurality of partially open positions, where a portion of the inlet 25 is covered by the gate plate 50; and a fully open position, where the entire inlet 25 is exposed. One of ordinary skill in the art will appreciate, however, that the gate plate 50 may also be configured to move linearly to provide a plurality of damper positions. In such a configuration, the gate plate 50 linearly slides over the inlet to provide a plurality of damper positions. In the disclosed examples, however, the gate plate 50 rotates generally parallel to the plane of the inlet 25.

The gate plate 50 can be rotated generally parallel to the inlet 25 either manually or with an actuator. In the disclosed examples, the damper 27 includes an actuator 58 that is operationally coupled to the gate plate 50. The actuator 58 may be either directly connected to the gate plate 50 or indirectly coupled to the gate plate 50 with one or more drive mechanisms (not shown) that are well known to those of ordinary skill in the art. The actuator 58 includes an enclosure 60 for housing an actuator motor or the like. The actuator 58 may further include a support flange 61, the function of which will be described in the following.

The gate plate 50 and the support flange 61 include fastening apertures 63 and 65, respectively, which receive a bolt 67 when aligned. The bolt 67 includes a threaded end for receiving a nut 69 to fasten the gate plate 50 to the support flange 61. However, when the nut 69 is tightened on the bolt 67, the gate plate 50 will be able to rotate relative to the flange 61. To provide for rotation of the gate plate 50 about the bolt 67, the diameter of the fastening aperture 63 of the gate plate 50 may be larger than the diameter of the bolt 67. Additionally, one or more washers, gaskets, bushings or the like (not shown) may be disposed around the bolt 67 between the nut 69 and the gate plate 50, and between the gate plate 50 and the support flange 61, to provide rotation of the gate plate 50 relative to the support flange 61 without any play or irregular movement.

The gate plate 50 may also include an arc-shaped slot 71, in which a stationary pin (not shown) slides to limit the rotation of the gate plate 50 relative to the inlet 25. Additionally, by providing an arc-shaped scale (not shown) along the slot 71, a user can determine the angular position of the gate plate 50 relative to the inlet 25, which can indicate the amount by which the inlet 25 is open.

Figure 2:
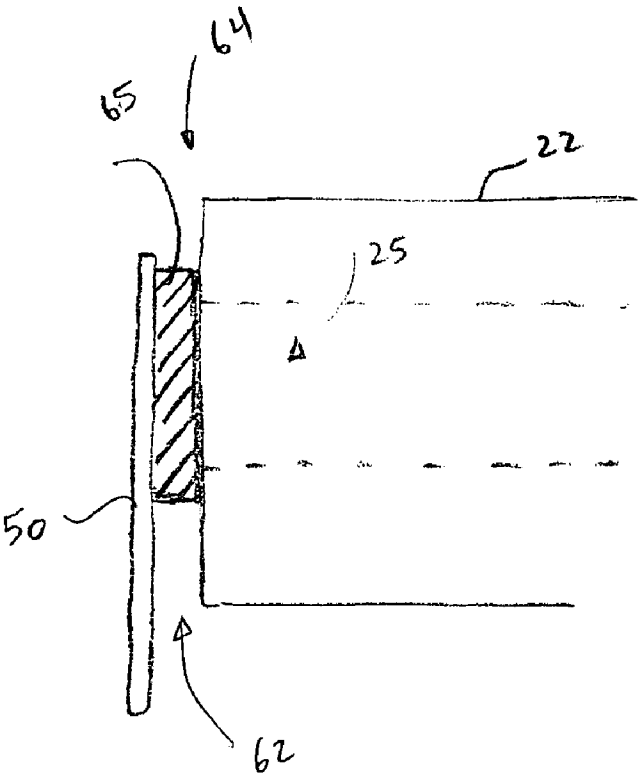
FIG. 2 is a front view of the gate valve damper of FIG. 1.

To provide rotation of the gate plate 50 generally parallel to the inlet 25 of the blower housing 22, a gap 62 can be provided between the gate plate 50 and the inlet 25 as shown in FIG. 2. However, for precise control of the amount of combustion air entering the inlet 25, the gap 62 must be substantially sealable when the damper 27 is in the closed position, or partially sealable when the damper 27 is in any of the partially open positions. To substantially seal the gap 62, the damper 27 can include any one of four exemplary seal assemblies 64, 164, 264 and 364 that are generally shown in FIGS. 1–3, 4–5, 6–8 and 9–10, respectively. In the following, the damper 27 and the four exemplary seal assemblies 64, 164, 264 and 364 will be described in detail with like parts having like reference numbers.

Figure 3:
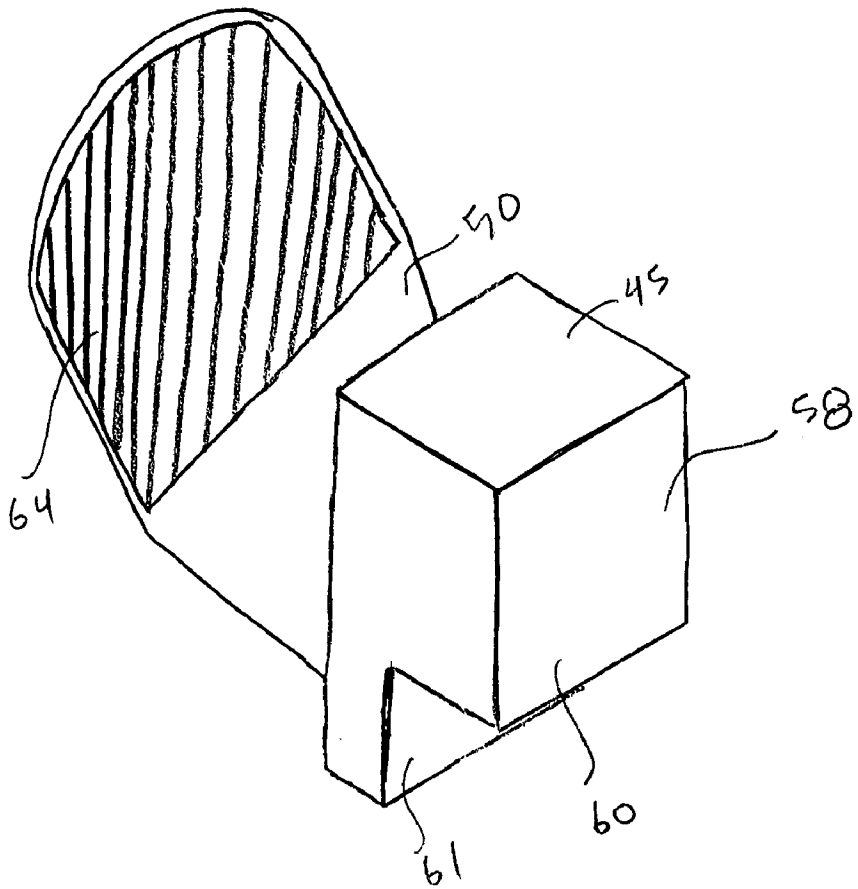
FIG. 3 is a perspective view of the gate valve damper of FIG. 1.

Referring to FIGS. 1–3, the damper 27 having the first exemplary seal assembly 64 is generally shown. The seal assembly 64 includes a sealing element 65 that is attached to an interior surface of the gate plate 50, which is the surface of the gate plate 50 facing the inlet 25. The sealing element 65 is sized to be larger than the inlet 25. Accordingly, when the gate plate 50 is nearly aligned with the inlet 25, i.e., the damper 27 is in the fully closed position, the sealing element 65 covers the inlet 25. The sealing element 65 is constructed from a flexible material and is thicker than the gap 62. As such, the sealing element 65 remains in a compressed state in the gap 62 so as to substantially seal portions of the perimeter of the inlet 25 that are positioned beneath the gate plate 50 during the rotation of the gate plate 50.

The actuator 58 can be attached to the blower housing 22 and rotates the gate plate 50. When the gate plate 50 rotates generally parallel to the inlet 25, it uncovers portions of the inlet 25 to allow air to enter the blower housing 22. However, because the sealing element 65 moves generally parallel to the inlet 25 in a compressed state, it substantially seals any portion of the perimeter of the inlet 25 that it covers. Accordingly, the gate plate 50 can provide precise control of the amount of air flow entering the blower housing 22. The sealing element 65 may be constructed from rubber, foam, or the like. In the first exemplary seal assembly 64, the sealing element 65 is constructed from Neoprene foam rubber.

Figure 4:
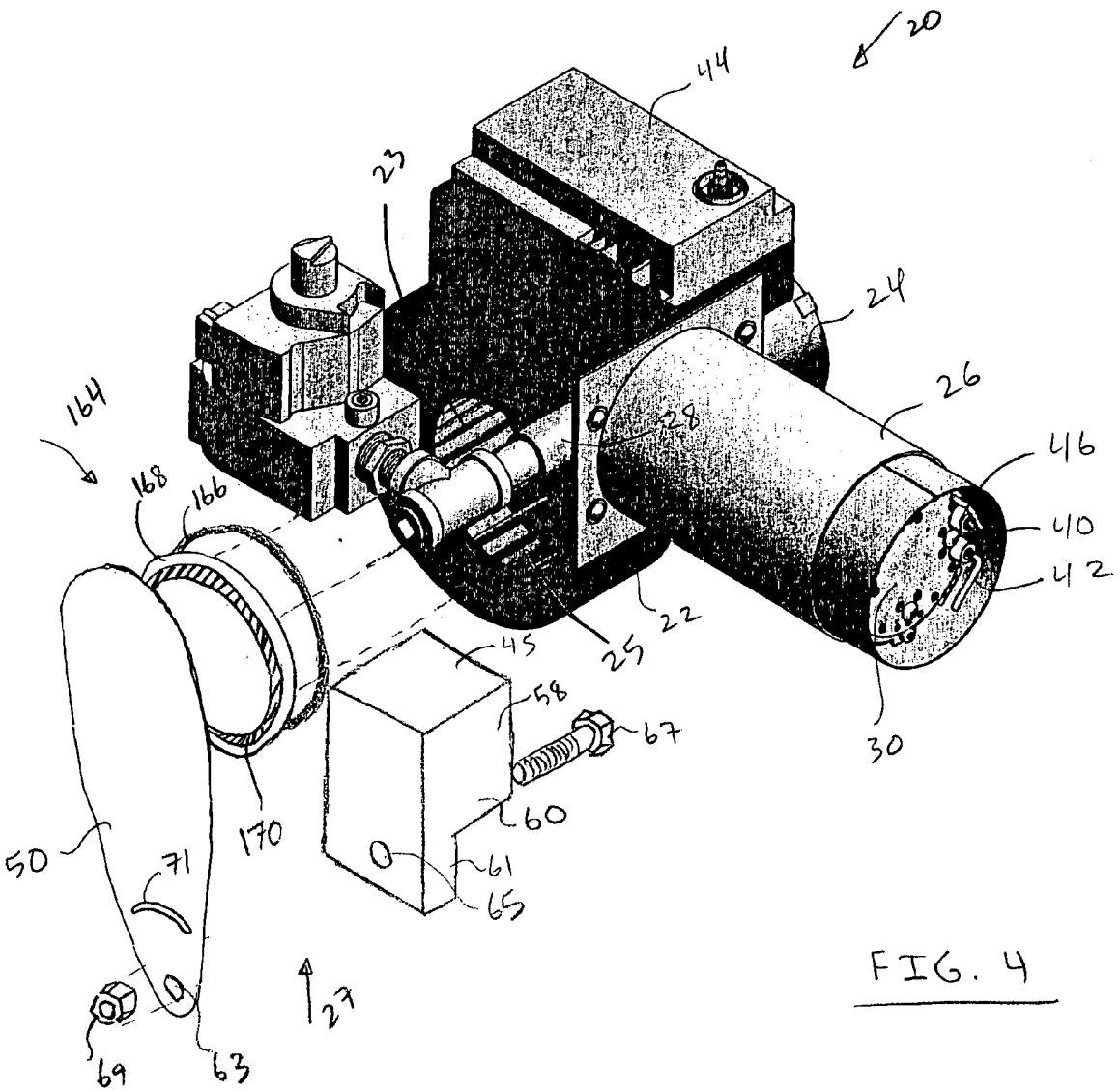
FIG. 4 is a perspective partially exploded view of a burner assembly having a gate valve damper with a seal assembly constructed in accordance with the teachings of the second example of the present disclosure.
Figure 5:
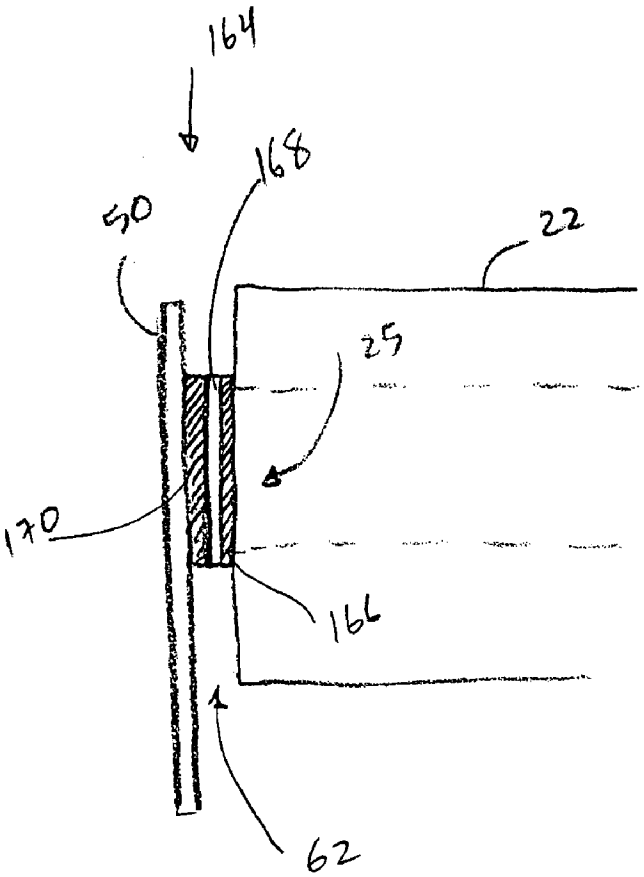
FIG. 5 is a front view of the gate valve damper of FIG. 4.
Figure 6:
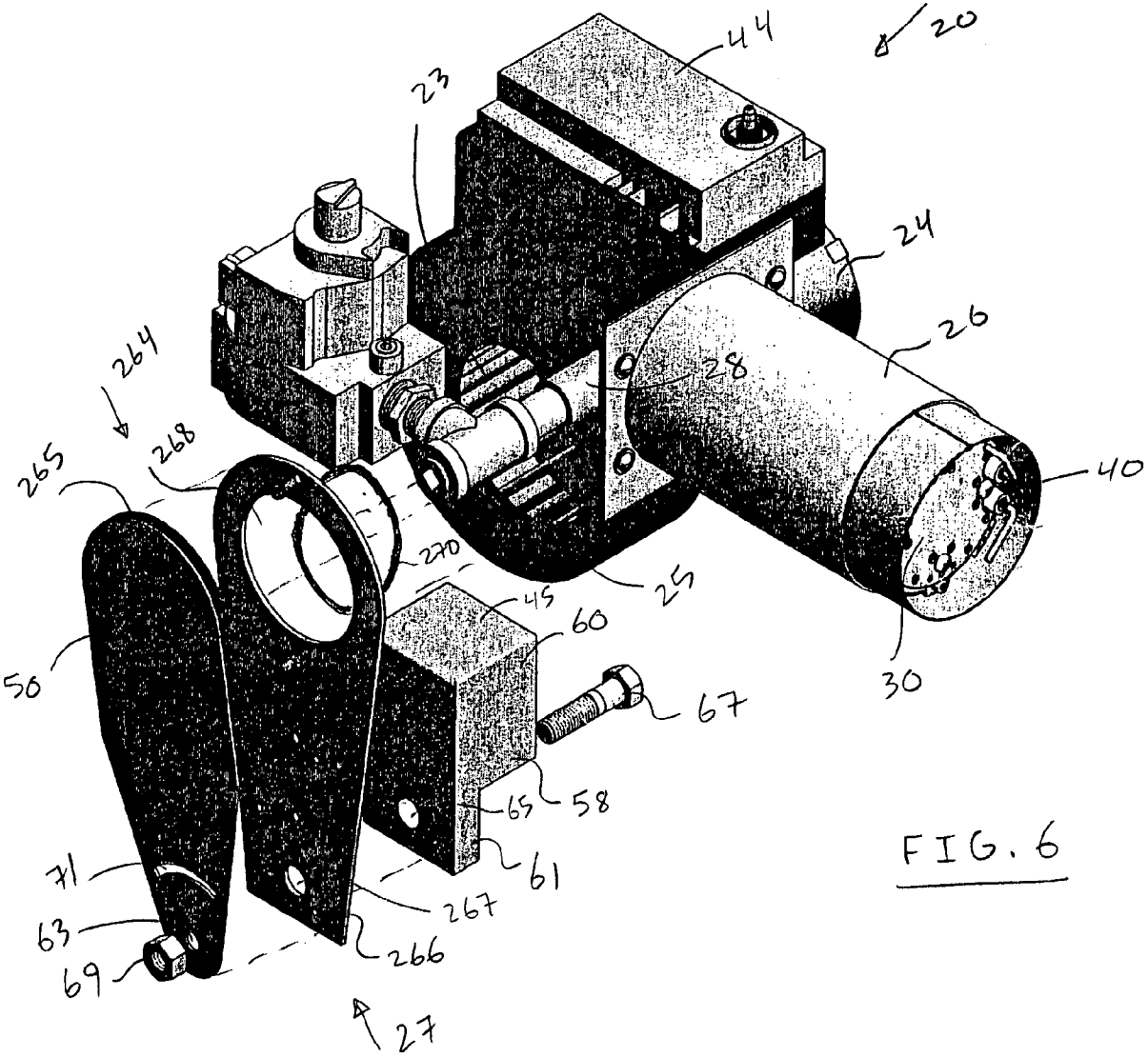
FIG. 6 is a perspective partially exploded view of a burner assembly having a gate valve damper with a seal assembly constructed in accordance with the teachings of the third example of the present disclosure.
Figure 7:
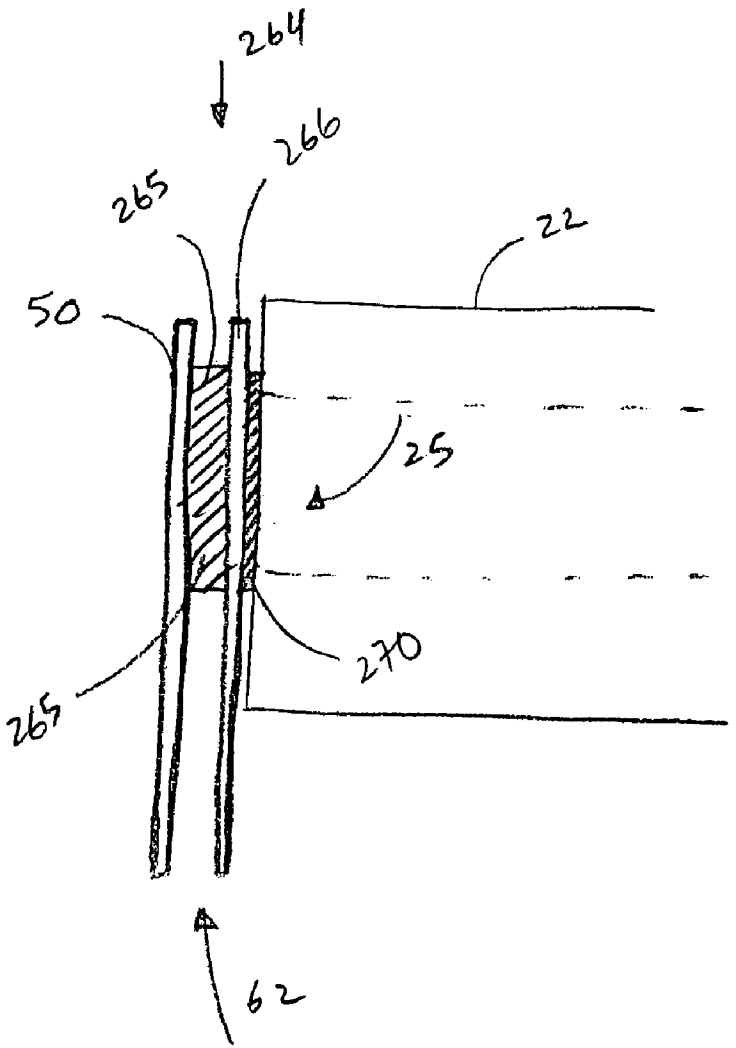
FIG. 7 is a front view of the gate valve damper of FIG. 6.
Figure 8:
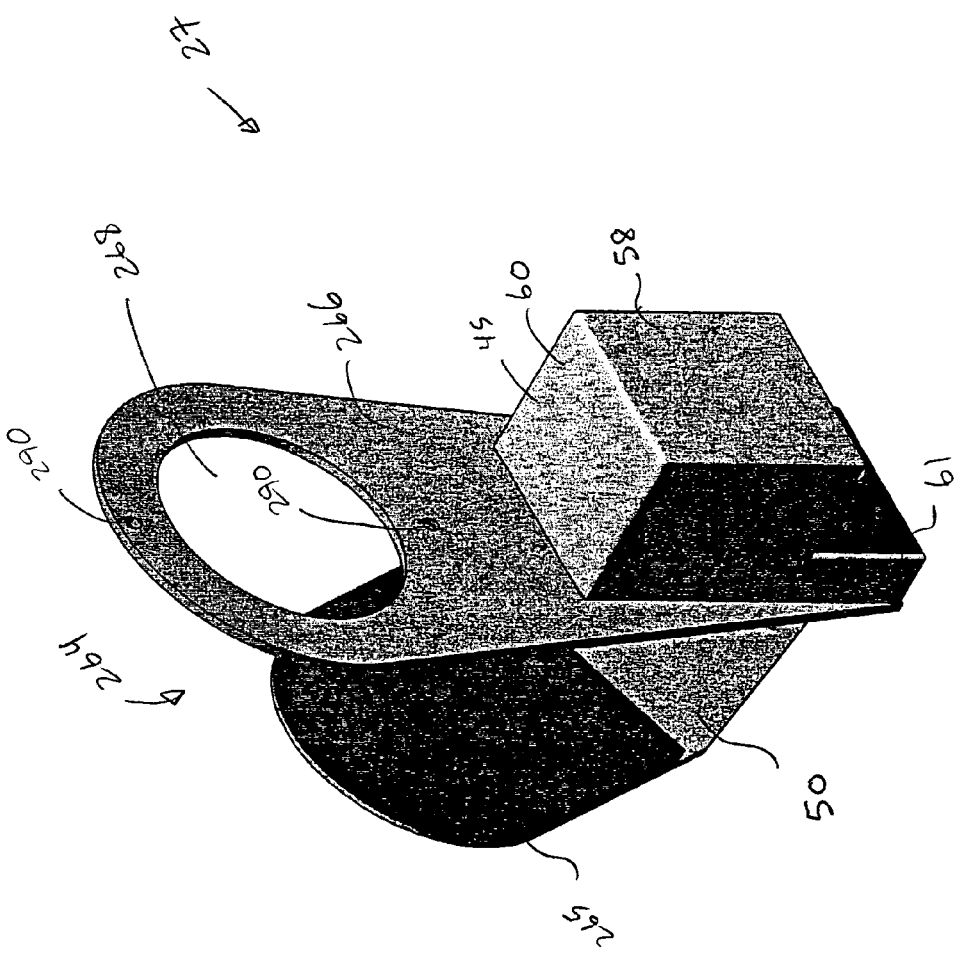
FIG. 8 is a perspective view of the gate valve damper of FIG. 6.
Figure 9:
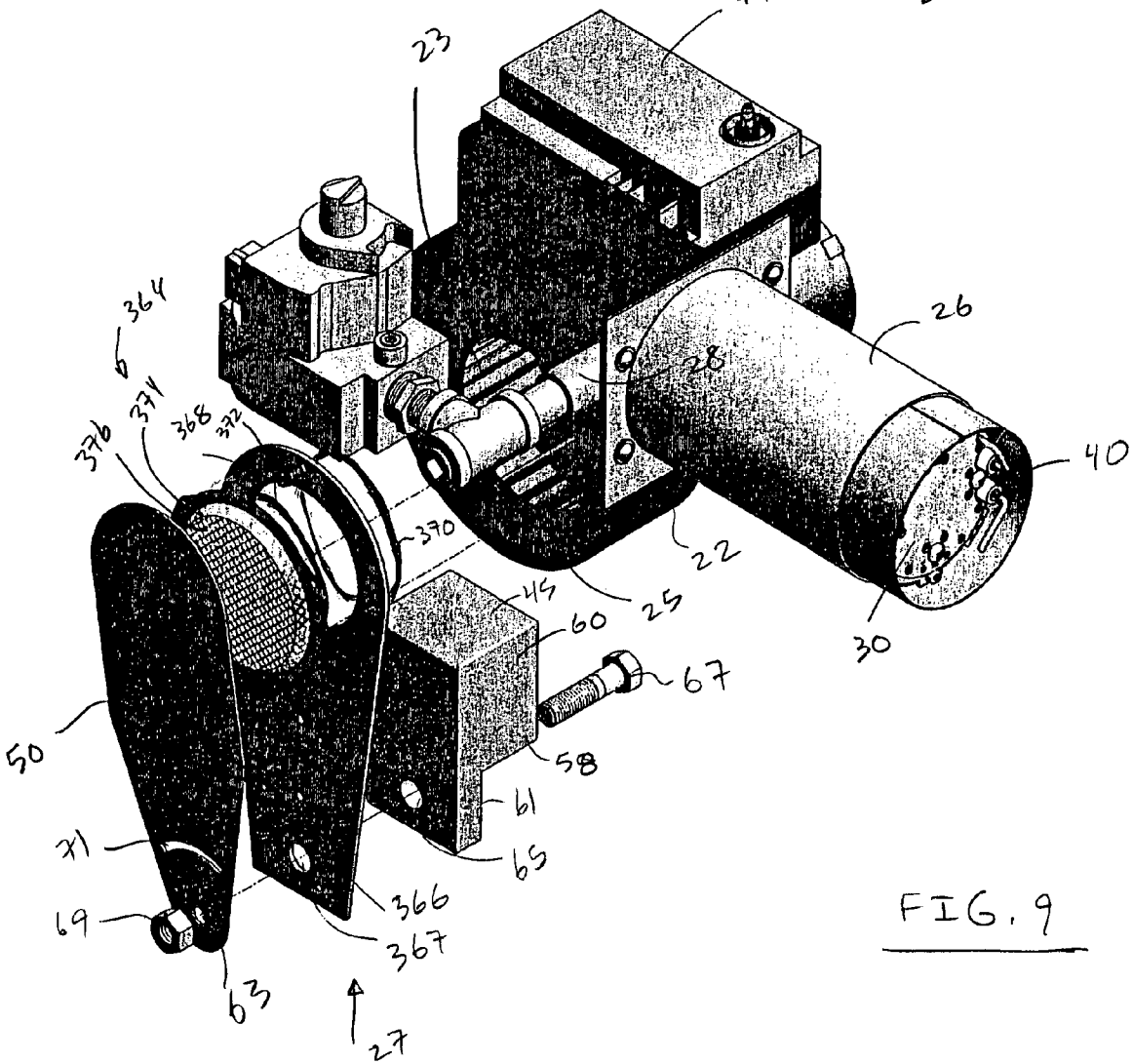
FIG. 9 is a perspective partially exploded view of a burner assembly having a gate valve damper with a seal assembly constructed in accordance with the teachings of the forth example of the present disclosure.
Figure 10:
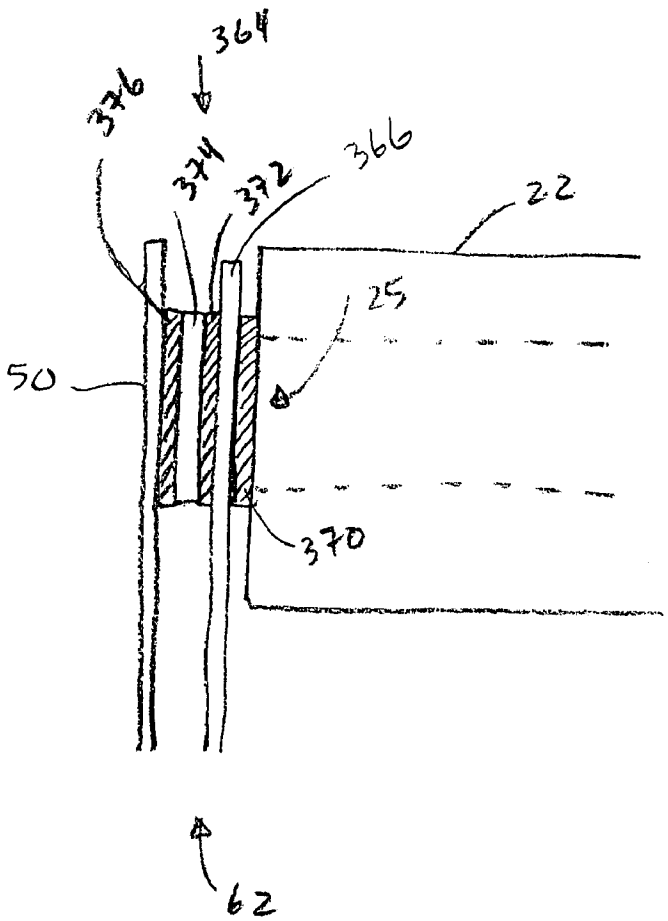
FIG. 10 is a front view of the gate valve damper of FIG. 9.

Referring to FIGS. 4 and 5, the damper 27 having the second exemplary seal assembly 164 is generally shown. The seal assembly 164 includes a mounting gasket 166, a flange 168, and a sealing gasket 170. The flange 168 is sized larger than the inlet 25 and is mounted over the inlet 25 in a concentric manner. To substantially seal any gap that may exist between the flange 168 and the perimeter of the inlet 25 when the flange 168 is mounted thereon, the mounting gasket 166 is placed between the flange 168 and the perimeter of the inlet 25. The sealing gasket 170 is mounted on the flange 168 so as to be positioned between the flange 168 and the gate plate 50. The sealing gasket 170 is constructed from a flexible material so as to be able to compress when it is in contact with the gate plate 50. When the gate plate 50 is aligned with the inlet 25 so as to cover the inlet 25, the sealing gasket 170 will be in contact with the gate plate 50 in a compressed state. Accordingly, the gate plate 50 in cooperation with the sealing gasket 170 can substantially seal the inlet 25.

The actuator 58 can be attached to the blower housing 22 and rotates the gate plate 50. When the gate plate 50 rotates generally parallel to the inlet 25, it uncovers portions of the inlet 25 to allow air to enter the blower housing 22. However, because the sealing gasket 170 remains compressed when contacting the gate plate 50, it substantially seals any portion of the gate plate 50 that it contacts. Accordingly, the gate plate 50 can provide precise control of the amount of air flow entering the blower housing 22. The sealing gasket 170 may be constructed from rubber, foam, or the like. In the second exemplary seal assembly 164, the sealing gasket 170 is constructed from rubber.

Referring to FIGS. 5–8, the damper 27 having the third exemplary seal assembly 264 is generally shown. The seal assembly 264 includes a base plate 266 having an airflow aperture 268. The base plate 266 is attached to the blower housing 22 such that the air flow aperture 268 is concentrically positioned over the inlet 25. Accordingly, combustion air can enter the inlet 25 through the air flow aperture 268. To seal any gap that may exist between the base plate 266 and the blower housing 22 when the base plate 266 is mounted thereon, the seal assembly 264 includes a mounting gasket 270 that is positioned between the base plate 266 and the blower housing 22.

The gate plate 50 rotates generally parallel to the base plate 266. When the gate plate 50 is nearly aligned with the base plate 266, it is positioned over the air flow aperture 268 to cover the air flow aperture 268. Rotation of the gate plate 50 to any position relative to the base plate 266 other than the aforementioned near aligned position uncovers the air flow aperture 268. Thus, rotation of the gate plate 50 relative to the base plate 266 will provide a plurality of damper positions, including a fully closed position, a plurality of partially open positions, and a fully open position.

The seal assembly 264 includes a sealing element 265 that is attached to an interior surface of the gate plate 50, which is the surface of the gate plate 50 facing the air flow aperture 268 or the inlet 25. The sealing element 265 is sized to be larger than the air flow aperture 268. Accordingly, when the gate plate 50 is nearly aligned with the base plate 266, i.e., the damper 27 is in the fully closed position, the sealing element 265 completely covers the air flow aperture 268. The gap 62 is defined by the space between the gate plate 50 and the base plate 266. The sealing element 265 is constructed from a flexible material and is thicker than the gap 62. As such, the sealing element 265 remains in a compressed state in the gap 62 so as to substantially seal portions of the perimeter of the air flow aperture 268 that will be positioned beneath the gate plate 50 during the rotation of the gate plate 50. When the gate plate 50 rotates relative to the base plate 266, it uncovers portions of the air flow aperture 268 to allow air to enter the blower housing 22. However, because the sealing element 265 moves generally parallel to the base plate 266 in a compressed state, it substantially seals any portion of the perimeter of the air flow aperture 268 that it covers. Accordingly, the gate plate 50 can provide precise control of the amount of air flow entering the blower housing 22. The sealing element 265 may be constructed from rubber, foam, or the like. The sealing element 265 of the third exemplary seal assembly 264 is constructed from Neoprene foam rubber.

Both the actuator 58 and the gate plate 50 are attached to and supported by the base plate 266, which is attached to and supported by the blower housing 22. Accordingly, the base plate is disposed between the gate plate 50 and the support flange 61 and includes an aperture 267 than aligns with the apertures 63 and 65 of the gate plate 50 and the support flange 61, respectively, to receive the bolt 67. Additionally, one or more washers, gaskets, bushings or the like (not shown) may be disposed around the bolt 67 between the nut 69 and the gate plate 50, and between the gate plate 50 and the base plate 266 to provide rotation of the gate plate 50 generally parallel to the base plate 266 without any play or irregular movement.

Referring to FIGS. 4 and 5, the damper 27 having the fourth exemplary seal assembly 364 is generally shown. The seal assembly 364 includes a base plate 366 having air flow aperture 368. The base plate 366 is attached to the blower housing 22 such that the air flow aperture 368 is concentrically positioned over the inlet 25. Accordingly, combustion air can enter the air flow inlet 25 through the air flow aperture 366. To seal any gap that may exist between the base plate 366 and the blower housing 22 when the base plate 36 is mounted thereon, the seal assembly 34 includes a first mounting gasket 370 that is positioned between the base plate 36 and the blower housing 22.

The seal assembly 364 further includes a second mounting gasket 372, a flange 374, and a sealing gasket 376. The flange 374 may be sized larger than the air flow aperture 368 and is mounted over the air flow aperture 368 in a concentric manner. Thus, the flange 374 is mounted on the base plate 366. To substantially seal any gap that may exist between the flange 374 and the perimeter of the air flow aperture 368 when the flange 374 is mounted thereon, the second mounting gasket 372 is placed between the flange 374 and the base plate 366. The second sealing gasket 376 is mounted on the flange 374 so as to be positioned between the flange 374 and the gate plate 50. The sealing gasket 376 is constructed from a flexible material so as to be able to compress when it is in contact with the gate plate 50. When the gate plate 50 is aligned with the air flow aperture 368 so as to cover the entire air flow aperture 368, the entire sealing gasket 376 will be in contact with the gate plate 50 in a compressed state. Accordingly, the gate plate 50 in cooperation with the sealing gasket 376 can substantially seal the inlet 25.

Both the actuator 58 and the gate plate 50 are attached to and supported by the base plate 366, which is attached to and supported by the blower housing 22. Accordingly, the base plate 366 is disposed between the gate plate 50 and the support flange 61 and includes an aperture 367 than aligns with the apertures 63 and 65 of the gate plate 50 and the support flange 61, respectively, to receive the bolt 67. Additionally, one or more washers, gaskets, bushings or the like (not shown) may be disposed around the bolt 67 between the nut 69 and the gate plate 50, and between the gate plate 50 and the base plate 366 to provide rotation of the gate plate 50 generally parallel to the base plate 366 without any play or irregular movement.

One of ordinary skill in the art will readily appreciate that because the actuator 58 and the gate plate 50 can be attached to the blower housing 22, as described in the first exemplary seal assembly 64 and the second exemplary seal assembly 164, the damper 27 can be a standalone damper 27 that can be retrofitted to any burner. Accordingly, the actuator 58 can be attached to any burner so as to provide the burner with the disclosed damper 27. Similarly, because the actuator 58 and the gate plate 50 are supported by the base plates 266 and 366 of the third exemplary seal assembly 264 and the fourth exemplary seal assembly 364, respectively, the damper 27 can be a standalone damper 27 that can be retrofitted to any burner. Accordingly, the base plates 266 and 366 can include a number of holes 290 (shown in FIG. 8) that can be aligned with corresponding holes (not shown) on the blower housing 22 to receive fasteners (not shown) for securely attaching any of the base plates 266 or 366 to the blower housing 22.

One of ordinary skill in the art will appreciate numerous well known methods by which the rotation of the gate plate 50 can be controlled to regulate the amount of air entering the blower 22 from the inlet 25. For example, an operator of the burner 20 can adjust the amount by which the inlet 25 receives combustion air by manually rotating the gate plate 50. In another example, the operator can make the same adjustment by a switch (not shown) that powers the actuator 58. In the disclosed example, however, the actuator 58 receives control signals from a controller (not shown) that regulates the amount of air entering the blower 22 from the inlet 25 by automatically adjusting the position of the gate plate 50. The controller may be part of the controller 44 of the burner 20 or an independent controller 45 for only controlling the actuator 58. The controller 45 may be housed in the enclosure 60.

The amount of air entering the blower 22 from the inlet 25 and the amount of combustion gas that is mixed with the air will influence numerous operational characteristics of the burner 20, including but not limited to, turndown ratio, $NO_x$ emissions, and CO emissions. Accordingly, a desired level of one or more such operational characteristics can be achieved by adjusting the amount of air and gas in the burner 20. The controller of the actuator 58 can adopt a control strategy based on the amount of air and gas necessary to achieve one or more desired burner operational characteristics. Such control strategy can be either predetermined and stored in a memory of the controller, or be continuously determined and updated during the operation of the burner 20.

For example, with a predetermined control strategy, the air pressure in the burner 20 can be measured based on the position of the damper 27. The amount of gas required to provide a desired burner characteristic based on the measured air pressure values can then be determined. Accordingly, each air pressure value, which is indicative of how much combustion air enters the blower housing 22 from the inlet 25, will correspond to a gas supply value to achieve one or more desired operational characteristics. Such values can be stored in the memory of the controller 45 and accessed during the operation of the burner 20. Thus, when a desired operational characteristic of the burner 20 is requested by a user, such as a certain BTU output for the burner 20, the controller 45 will send a command to the actuator 58 to rotate the gate plate 50 by an amount needed to achieve such a BTU output. The controller 45 will then supply a corresponding amount of gas based on the predetermined values by opening a gas valve (not shown) of the burner 20.

The control strategy can also be determined and updated continuously during the operation of the burner 20. For example, the controller 45 can include one or more feedback and/or feedforward controllers (not shown) that receive inputs from a number of sensors disposed at various locations in the burner 20. The sensor inputs are then used to determine how much air and gas should be supplied to the burner. The controller 45 sends signals to the actuator 58 to open or close the damper 27 and accordingly modulates the gas supply to the burner 20. The controller 45 can be a real time controller to provide continuous and real time opening and closing at the damper 27 as necessary.

The damper 27 can be set to a fully open position, a fully closed position, and a plurality of open positions by rotating the gate plate 50 as described in the foregoing. Additionally, each of the sealing assemblies 64, 164, 264 and 364 substantially prevents air from entering the inlet 25 from anywhere but portions of the inlet 25 that are not positioned under the gate plate 50. Accordingly, the damper 27 can provide precise control of the amount of air entering the blower 22 from the inlet 25. Such precise control of the air being supplied to the burner 20 provides precise control of the BTU output of the burner 20, the capability to achieve high turndown ratios without sacrificing emissions, such as $NO_x$ and CO emissions, and the capability to achieve high burner efficiency. Furthermore, the disclosed damper 27 includes very few moving parts, which provides operational longevity, simple maintenance, low complexity, and low operational noise and vibration. Additionally, the controller of the damper 27, or alternately, the controller 44, provide automated control of the dampers 27.

Persons of ordinary skill in the art will appreciate that, although the teachings of the invention have been illustrated in connection with certain embodiments, there is no intent to limit the invention to such embodiments. On the contrary, the intention of this application is to cover all modifications and embodiments fairly falling within the scope of the teachings of the invention.

What is claimed is:

1. A burner assembly comprising:

a blower having an inlet;

a gate plate moveable relative to the inlet and adapted to control combustion air entering the blower from the inlet; and a seal assembly disposed between the gate plate and the inlet.

2. The burner assembly of claim 1, wherein the gate plate is moveable generally parallel to the inlet.

3. The burner assembly of claim 1, the seal assembly comprising a sealing element attached to the gate plate.

4. The burner assembly of claim 1, the seal assembly comprising:

a flange mounted over the inlet; and a sealing gasket mounted over the flange.

5. The burner assembly of claim 4, the seal assembly further comprising a mounting gasket disposed between the flange and the inlet.

6. The burner assembly of claim 1, the seal assembly comprising:

a base plate having an air flow aperture in airflow communication with the inlet, the base plate being attached to the blower; and a sealing element attached to the gate plate.

7. The burner assembly of claim 6, the seal assembly further comprising a mounting gasket disposed between the base plate and the blower.

8. The burner assembly of claim 1, the seal assembly comprising:

a base plate having an air flow aperture in airflow communication with the inlet, the base plate being attached to the blower;

a flange mounted over the aperture; and a sealing gasket mounted over the flange.

9. The burner assembly of claim 8, the seal assembly further comprising a first mounting gasket disposed between the base plate and the blower, and a second mounting gasket disposed between the flange and the base plate.

10. The burner assembly of claim 1, further comprising an actuator operationally coupled to the gate plate.

11. The burner assembly of claim 10, further comprising a controller adapted to control the actuator.

12. A damper for a burner assembly, the damper comprising:

a base plate mounted on the burner assembly and having an aperture sized to communicate with an air inlet of the burner assembly;

a gate plate moveable relative to the inlet and adapted to control the supply of combustion air entering the inlet from the aperture; and a seal assembly disposed between the base plate and the gate plate.

13. The damper of claim 12, wherein the gate plate is moveable generally parallel to the base plate.

14. The damper of claim 12, the seal assembly comprising a sealing element disposed on the gate plate.

15. The damper of claim 12, the seal assembly comprising:

a flange mounted over the aperture; and a sealing gasket mounted over the flange.

16. The damper of claim 15, the seal assembly further comprising a first mounting gasket disposed between the base plate and the blower, and a second mounting gasket disposed between the flange and the base plate.

17. The damper of claim 12, further comprising an actuator operationally coupled to the gate plate to move the gate plate relative to the base plate.

18. The damper of claim 17, further comprising a controller adapted to control the actuator.

19. A burner assembly, comprising:

a blower having an air inlet;

a base plate mounted on the inlet and having an aperture sized to communicate with the inlet; and a gate plate moveable generally parallel to the inlet and adapted to control combustion air entering the inlet from the aperture; and a seal assembly disposed between the base plate and the gate plate.

20. The burner assembly of claim 19, the seal assembly comprising a sealing element disposed on the gate plate.

21. The burner assembly of claim 20, the seal assembly comprising:

a flange mounted over the aperture; and a sealing gasket mounted over the flange.

22. The burner assembly of claim 21, the seal assembly further comprising a first mounting gasket disposed between the base plate and the blower, and a second mounting gasket disposed between the flange and the base plate.

23. The burner assembly of claim 19, further comprising an actuator operationally coupled to the gate plate to move the gate plate relative to the base plate.

24. The burner assembly of claim 23, further comprising a controller adapted to control the actuator.

* * * * *